US005173969A

United States Patent [19]

Fredrickson

[11] Patent Number: 5,173,969

[45] Date of Patent: Dec. 29, 1992

[54] WOODEN CUMMERBUND

[76] Inventor: Patrick Fredrickson, 9302 Redwood Rd. #A-305, Redmond, Wash. 98052

[21] Appl. No.: 782,036

[22] Filed: Oct. 24, 1991

[51] Int. Cl.[5] ..... A41F 9/00

[52] U.S. Cl. ..... 2/311; 2/338

[58] Field of Search ..... 2/311, 338, 300, 301, 2/321, 336, 2.5, 309, 312, 243

[56] References Cited

U.S. PATENT DOCUMENTS

| | | | |
|---|---|---|---|
| 644,557 | 2/1900 | Koch | 2/311 |
| 1,597,508 | 8/1926 | Brenner | 2/338 |
| 2,914,070 | 11/1959 | Kellner et al. | 2/311 |
| 3,617,425 | 2/1971 | White | 2/102 |
| 3,829,902 | 8/1974 | Fisher | 2/338 |
| 4,546,494 | 10/1985 | Garber | 2/144 |
| 4,617,685 | 10/1986 | Grandis | 2/338 |
| 4,627,113 | 12/1986 | Lord | 2/144 |
| 4,642,855 | 2/1987 | Densmore | 24/580 |
| 5,036,550 | 8/1991 | Wilsey | 2/144 |

FOREIGN PATENT DOCUMENTS

| | | | |
|---|---|---|---|
| 2579882 | 10/1986 | France | 2/311 |
| 305749 | 2/1933 | Italy | 2/311 |

*Primary Examiner*—Andrew M. Falik
*Assistant Examiner*—Amy B. Vanatta
*Attorney, Agent, or Firm*—Lynn G. Foster

[57] ABSTRACT

An arcuate wooden cummerbund with or without associated accessories. Two methods for making the wooden cummerbund are disclosed. When accessories are included, they may comprise coordinating wooden ties, matching cuff links. A storing and carrying case is disclosed for the wooden cummerbund and accessories.

3 Claims, 2 Drawing Sheets

WOODEN CUMMERBUND

FIELD OF INVENTION

This invention relates to clothing accessories and in particular to cummerbunds and associated articles of clothing.

BACKGROUND AND DESCRIPTION OF RELATED ART

Cummerbunds are generally known in the art as cloth sashes worn at the waist with formal attire. Cummerbunds were originally worn by men in India. In modern dress, cummerbunds are commonly worn in the place of a vest in men's clothes, particularly in formal wear. Cummerbunds are also adapted for use in various styles of women's clothes.

BRIEF SUMMARY AND OBJECTS OF THE INVENTION

In brief summary, this invention comprises a novel cummerbund manufactured from wood. The wooden cummerbund is formed by a unique process which provides a comfortable, waist cover which conforms to the structure and curvature of a wearer. As the cummerbund is an article of clothing worn for appearance, the wooden cummerbund provides a singular and distinctive look for the wearer. Associated wooden dress accessories may be provided for coordinated attire. Such accessories may comprise ties, cuff links, belt buckles, and arm bands which feature wood grains and colors similar to that of the wooden cummerbund.

Accordingly, it is a primary object to provide a wooden cummerbund.

It is another primary object to provide a process for making the wooden cummerbund.

It is another object to provide an attractive, well crafted wooden cummerbund for use with formal attire.

It is another object to provide clothing accessories made from wood which coordinate with a wooden cummerbund.

It is another object to provide a cover or container in which a rigid, shape retaining cummerbund is stored during periods of non-use.

These and other objects and features of the present invention will be apparent from the detailed description taken with reference to accompanying drawings.

DETAILED DESCRIPTION OF THE ILLUSTRATED EMBODIMENTS

In this description, the term proximal is used to indicate the side of a device normally closest to a wearer or user when the device is being used. The term distal refers to the other side. Anterior refers to the front of the wearer or user while posterior refers to the back of the wearer or user.

Figure 1:
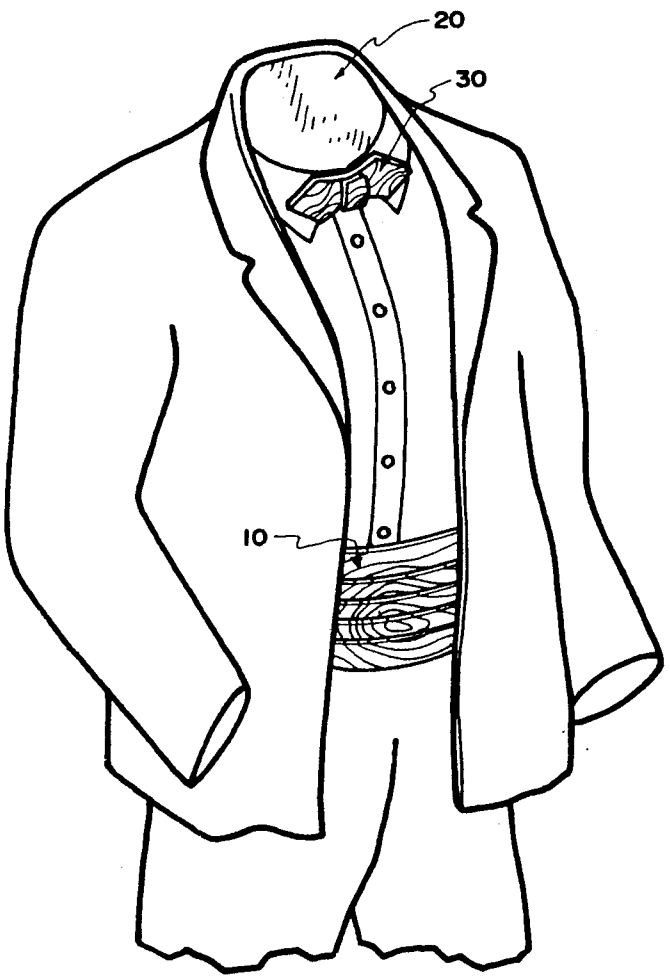
FIG. 1 is a combination of formal attire disposed on a mannequin comprising a wooden cummerbund and wooden tie.

Reference is now made to the drawings wherein like numerals are used to designate like parts throughout. A presently preferred form of the present invention is illustrated in FIGS. 1–6 and comprises a wooden cummerbund 10, as partially seen in FIG. 1 placed on a mannequin 20 dressed in formal attire. The normally visible portion of cummerbund 10 comprises a wooden plate 12, arcuately formed to be comfortably contiguous with the user's clothing about the abdomen. A wooden tie 30 which comprises wood colors and patterns complementary to plate 12 is also illustrated in FIG. 1, at the neck of the mannequin 20.

Figure 2:
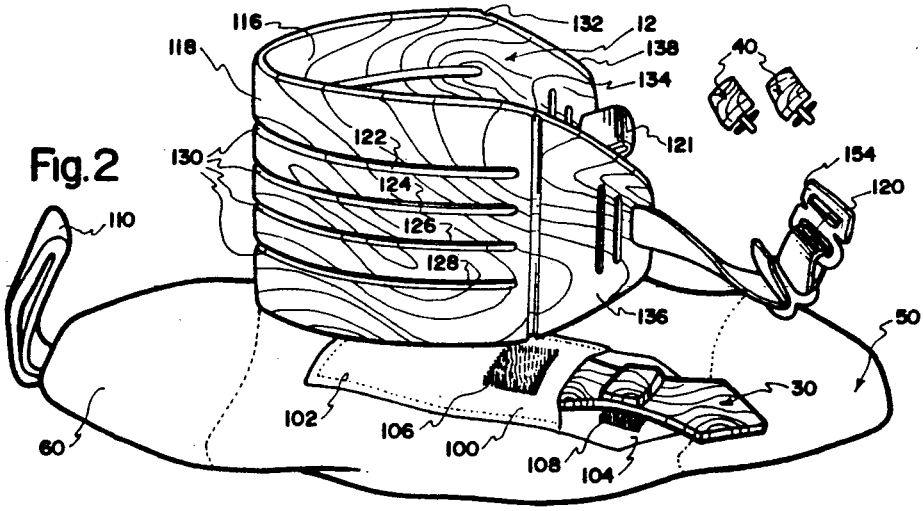
FIG. 2 is a perspective of a carrying case for the cummerbund and accessories, with a side perspective of the wooden cummerbund, the wooden tie, and wooden cuff link accessories seen therewith.

Cummerbund 10 and tie 30 and a pair of cuff links 40 are illustrated in FIG. 2 in exploded perspective adjacent to a carrying case 50. Carrying case 50 provides a safe and protective cover, container or enclosure for transporting and storing the cummerbund 10 and accessories, if any. The cummerbund 10, tie 30 and cuff link 40, when used together, comprises a harmonizing display of attractive wooden pieces, which permits the wearer to display them as a coordinated set.

On one side 60, the carrying case 50 comprises at least one pocket 100 wherein one or more smaller accessories, such as tie 30, are stored. As seen in FIG. 2, pocket 100 may be attached to carrying case 50 by stitching 102 or by other suitable known attachment processes. Pocket 100 comprises a closing and containing flap 104 which is releasably held in a closed position by hook and loop material swatches 106, 108. Depending upon the motif and look desired for carrying case 50, other items for closing and containing flap 104 may be used, such as buttons, snaps, and clasps which are also well known in the art. Each pocket 100 is sized and shaped to securely hold and protect any item accessibly stored therein. Preferably, for ease of transport, a carrying loop 110 is attached to one end of carrying case 50.

Figure 3:
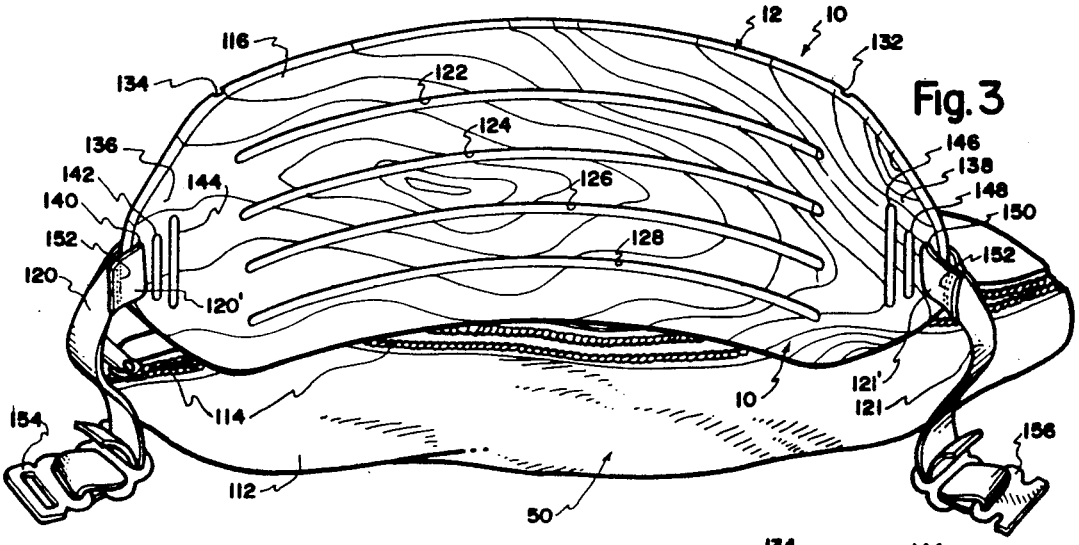
FIG. 3 is a perspective of the side of the cummerbund proximal to a wearer disposed on the cummerbund receiving side of the carrying case.

Accessible entry for cummerbund 10 into carrying case 50 is provided on the reverse side 112 of carrying case 50, as best seen in FIG. 3. A longitudinally directed, medially disposed zipper 114, when given, provides full length entry for cummerbund 10 into carrying case 50. Carrying case 50 is preferably made from soft leather or a long wearing material, such as vinyl, usable in soft cover suit cases and conforms to the curvature of arcuate plate 12 which comprises the wooden portion of cummerbund 10.

Figure 4:
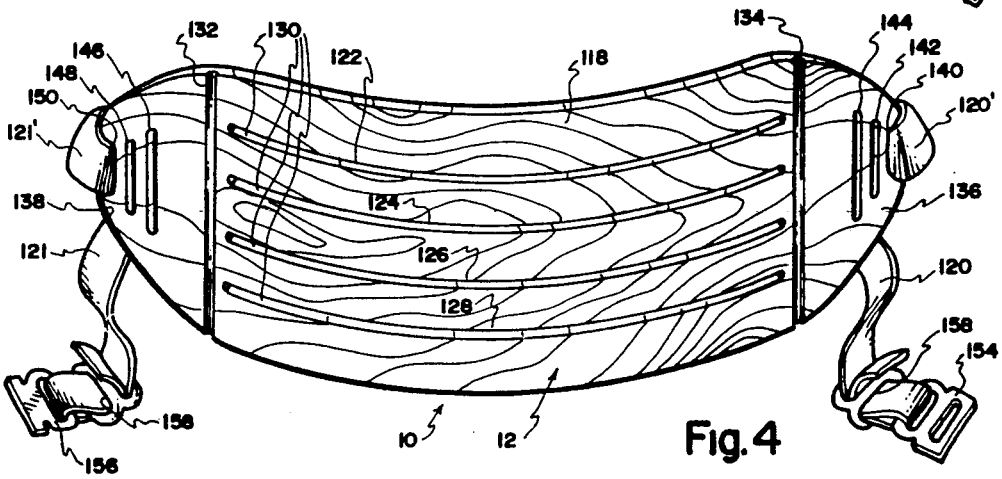
FIG. 4 is a perspective of the side of the cummerbund distal to the wearer.

The proximal side 116 and distal side 118 of illustrated embodiment of plate 12 are respectively best seen in FIGS. 3 and 4. As seen therein, plate 12 comprises a abdominal conforming arc for ease of wear and natural appearance. The abdominal conformance is important to appearance quality of cummerbund 10. Further, the plate 12 displays an attractive wood grain surface, especially on distal side 118.

In the illustrated embodiment, plate 12 comprises a substantially constant vertical medial height and arcuately rounded edges at each end 136 and 138. The vertical height of plate 12 of cummerbund 10 is dimensionally similar to the height of a cloth cummerbund while the horizontal dimension of plate 12, when disposed over the anterior of the abdomen, covers essentially the same anterior abdominal area as a cloth cummerbund. A pair of straps 120 and 121 are affixed to plate 12 for facile attachment around the back of the wearer.

To fit the taste of the designer and wearer, individually designed patterns are preferably sculpted or engraved into the wood to further enhance appearance and through the wood to provide vents. As best seen in FIGS. 2–4, the illustrated embodiment of plate 12 comprises a series of four medially disposed horizontal cuts 122, 124, 126, and 128. Each cut comprises a beveled edge 130 disposed on distal side 118. Although variable, depending upon the look desired, the bevel of edge 130 in plate 12 is preferably cut to an angle of 45 degrees with the distal side 118 surface.

Plate 12 also comprises a pair of rectangular vertically oriented grooves 132, 134 across the full height of plate 12 and disposed normal to horizontal cuts 122, 124, 126, and 128. As seen in FIG. 4, end 136, disposed on the right hand therein, comprises three vertical slots 140, 142, and 144. Slots 142 and 144 each provide an aesthetic addition to the appearance of plate 12 while slot 140 receives an end loop of strap 120 to plate 12. On end 138 disposed on the left hand side of plate 12 in FIG. 4, three other vertical slots 146, 148, and 150 also exist. Attachment of one end loop of strap 121 is made through slot 150.

Preferably, each strap 120 and 121 is made from stretchable belt or strap material which is known and available in the industry and affixed respectively at one end by a loop 120', 121', to plate 12. Each loop 120', 121' is illustrated as being closed by stitching 152 although other belt materials and methods of loop closure or attachment may be used. A buckle 154 is attached to the other end of strap 120. A buckle 156, which is complementary to buckle 154 and which releasably connects to buckle 154 to releasably couple straps 120 and 121 together, is attached to the other end of strap 121. At least one of the buckles 154, 156 comprises a belt length adjustment clip 158 similar to that used in automobile and airplane seat belts for adjusting the length of the straps to fit the wearer. Thus, when attached to plate 12, straps 120 and 121 complete the assembly of cummerbund 10 and provide for releasably affixing cummerbund 10 to the wearer.

Figure 5:
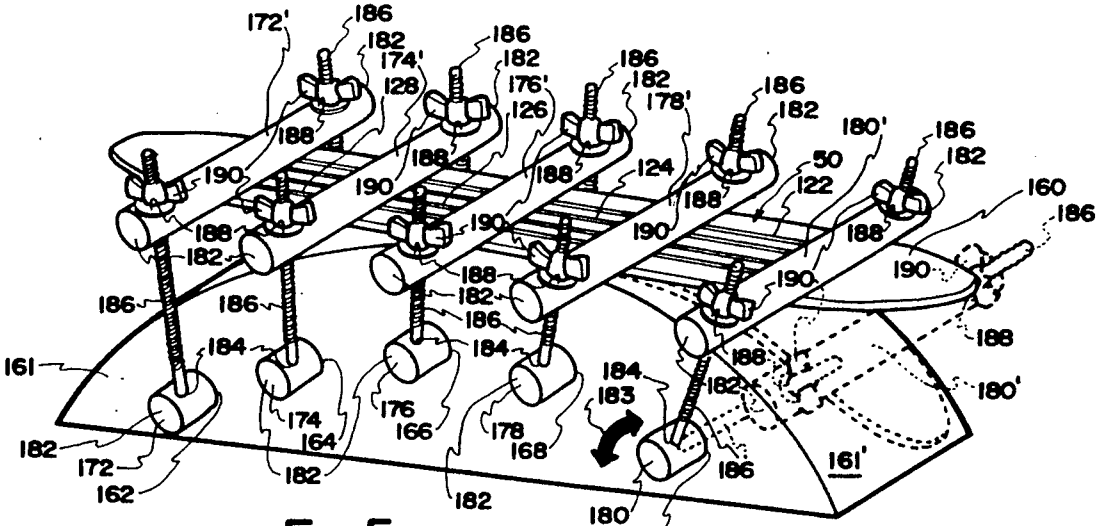
FIG. 5 is a perspective of a steam forming mold apparatus used to form a wood part used to make a plate for the cummerbund.

One apparatus which may be used for making cummerbund 10 is seen in FIG. 5. Preparatory to making cummerbund 10, a relatively flat piece of wood is carefully selected, usually in rough cut form. By way of example, the piece of wood may be five feet long, six inches wide and one inch thick. The piece of wood is cut into four equal boards of equal thickness, using, for example, a bandsaw. A plexiglass pattern, which corresponds in shape to the plate 12, is moved about the surface of each cut wood segment to determine the best wood grain pattern area. Once the area which provides the best grain pattern is determined, a line is traced around the plexiglass pattern to mark an outside border.

The plexiglass pattern is preferably releasably affixed inside the traced line using double backed tape. A router with a guide bushing is then preferably used to cut the wood segment to the exact shape of the plexiglass pattern to form a flat part 160, best seen in FIG. 5. The plexiglass pattern is then removed. The side of the wood which is to become the distal side 118 of plate 12 is placed face down on the top of a table saw. A 1/16 Kerf-fine tooth blade is raised one-sixteenth inch from the top of the table saw. A relief cut is made across the width of plate 12 to form a groove 132 in part 160 preferably disposed four inches from one end. A second relief cut is similarly disposed and made on the other end to form groove 134. Each groove 132, 134 is hidden from view in FIG. 5, but is seen in plate 12 in FIG. 4. Each rectangular groove 132, 134 provides an exterior border for horizontal cuts 122, 124, 126 and 128 and serves as a "false seam" design element to simulate a cloth cummerbund.

By setting the table saw blade at a 45° angle, a 45° degree channel is repeatedly carved four times to form an array of horizontal cuts 122, 124, 126 and 128 symmetrically disposed across the face of plate 12 between grooves 132 and 134. Each 45° horizontal cut is disposed in plate 12 such that, when worn as plate 12 in cummerbund 10, the view through each horizontal cut 122, 124, 126, and 128 is restricted from above. While each horizontal cut 122, 124, 126 and 128 preferably breaches both front and rear surfaces (which will become the proximal and distal sides 116 and 118, respectively, of plate 12), a shallower horizontal cut may be made in the front surface, (which will become distal side 118) providing an angular groove rather than a slot passing entirely through the wood segment. The number of cuts, their location and orientation, may be increased or decreased to augment the selected wood grain, pattern, and appearance.

Double sided tape is applied to part 160 on what is to become the proximal side 116 of plate 12. Part 160 is then releasably affixed to a large sheet of plexiglass for safe routing. A router is conventionally used to create each slot 140, 142, 144, 146, 148, and 150. The slots may be beveled, spaced at one-half inch intervals and symmetrically disposed at each end 136 and 138, respectively, although other numbers of slots and patterns may be used within the scope of the invention. Each inwardly disposed slot is also preferably elongated as seen in FIGS. 2–4 for aesthetic reasons.

Once the wood segment properly corresponds to the pattern, part 160 is ready to be bent in to an abdomen conforming arc. One process for bending part 160 comprises the use of steam. As seen in FIG. 5, an arcuate mold 161 which is preferably in the form of a section from a circular cylinder comprises a series of holes 162, 164, 166, 168, and 170 extending transverse to the mold 161. Each hole or bore 162, 164, 166, 168, and 170 is filled with a dowel 172, 174, 176, 178, and 180, respectively, which extends through and for a predetermined distance beyond each side of mold 161 to an end 182. Each hole 162, 164, 166, 168, and 170 is sized to permit the associated dowel 172, 174, 176, 178, and 180 to facilely rotate therein as diagrammatically indicated by arrow 183. Inwardly disposed from each end 82, each dowel 172, 174, 176, 178, and 180 comprises a transverse threaded hole 184 through which a long bolt 186 is threadedly disposed. Each long bolt 186 comprises sufficient length to couple to another top dowel 172', 174', 176', 178', and 180', disposed above mold 161 and linear part 160 residing thereon, by use of a washer 188 and a coupling wingnut 190.

To provide a desired bend in plate 12, part 160 is placed upon mold 161 as seen in FIG. 5. The ends of each dowel 172, 174, 176, 178, and 180 is coupled to the respective ends of another dowel 172', 174', 176', 178', and 180', respectively, by two long bolts 186. A washer 188 and a wingnut 190 are disposed upon the exposed distal end of each long bolt 186 and firmly tightened to forcibly press each dowel 172', 174', 176', 178', and 180' against part 160 to apply force upon and hold part 160 centered and true.

So coupled, mold 161 and part 160 are placed in a steam box for a predetermined period of time. Under some conditions, the period may be five minutes. Access is provided to the mold 161 and part 160 at the end of the initial period, and each dowel 172', 174', 176', 178', and 180' is again firmly tightened upon part 160 such that each dowel 172', 174', 176', 178', and 180' forces part 160 closer to the surface 161' of mold 161. This stepped approach is repeated with the application of steam between each tightening and bending step. Attention is drawn to FIG. 5, wherein the dashed line portion of FIG. 5 shows part 160 partially bent under the force of at least dowel pair 180, 180'. For clarity only, the movement of part 160 and related rotating and tightening movement of dowel pair 180, 180' is shown. It should be understood that each dowel pair 178, 178'; 176, 176', 174, 174'; and 172, 172' are similarly rotated and tightened as part 160 is incrementally bent.

The dowel pair 180, 180' rotates in orientation as indicated by the two positions of pair 180, 180', illustrated in FIG. 5, to maintain a substantially normal bending force on part 160 as the bending and tightening continues. The mold 161 and part 160 are returned to the steam box for another suitable period of time, which may be 5 minutes. The process of providing access, tightening the dowels upon part 160 and returning the mold 161 and part 160 to the steam box for the other period of time is repeated until part 160 completely conforms to surface 161' of mold 161, at which time the mold 161 and part 160 are removed from the steam box and left to stand for yet another predetermined period of time, which may be one hour. The part 160 is then removed from mold 161 preparatory to finishing.

Figure 6:
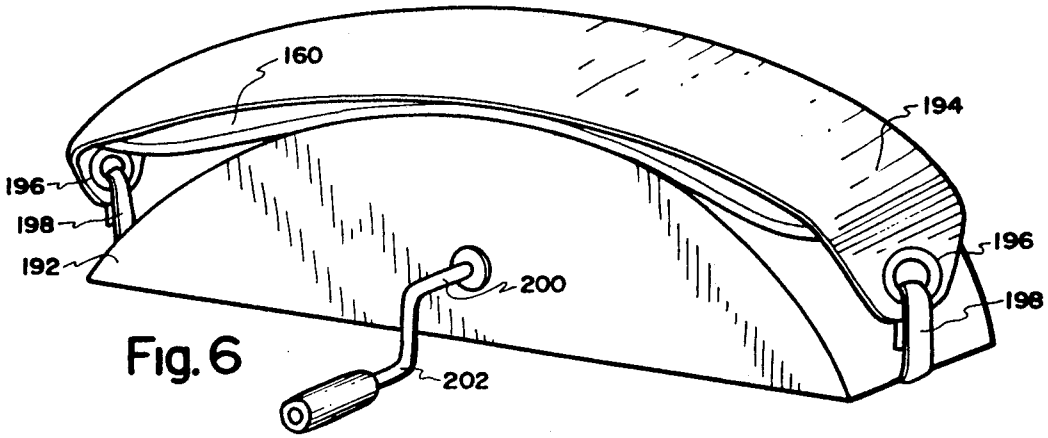
FIG. 6 is a perspective of a microwave forming mold apparatus for the plate of the cummerbund.

Another process of bending part 160 comprises the use of a microwave oven. As seen in FIG. 6, which shows part 160 partially bent, the microwave bending apparatus comprises a mold 192 which comprises substantially the same shape as mold 161, but care is taken to make mold 192 out of material which is electrically compatible with and unaffected by the energy of a microwave oven. Part 160 is compressively forced to conform to compressive stress provided by of a canvas band which is disposed longitudinally across part 160 as it resides upon mold 192. On each end, canvas band 194 comprises a plastic grommet 196 through which a heat tolerant cord 198 is passed. The cords are joined to a rachetted tightening shaft 200 attached to a crank handle 202, as illustrated in FIG. 6. Each part used in the microwave oven, comprising mold 192 and associated shaft 200 and handle 202, canvas band 194, grommet 196 and cord 198, is selected from material which is usable in and unaffected by microwaves. Such materials are known and available in the art.

Before first placing part 160 and mold 192 into the microwave oven, part 160 is disposed upon mold 192 and forcibly and compressively affixed thereat. The part 160 and mold 192, so combined, are placed in a microwave oven heated at a high heat setting for a predetermined period of time. The period is dependent upon of the power of the microwave, but may be three to ten minutes. At the end of each period, part 160 and mold 192 are removed from the microwave and pressure is increased upon part 160 by turning shaft 200 to shorten the free length of each cord 198. The orientation of part 160 and mold 192 is rotated 180°, to assure more uniform heating of part 160, and returned to microwave for the predetermined period. At the end of each successive period, part 160 and mold 192 are removed from the microwave and the cord shortening, pressure increasing, and returning steps are continued incrementally until part 160 conforms to the shape of mold 192. At that time, shaft 200 is further tightened and part 160 is cooled for another predetermined period of time. The period for cooling may be one hour. Once cooled, part 160 is removed from mold 192.

Independent of the manner of bending, each part 160 is finished by finishing methods well known in making high quality wooden parts. Preferably, the finishing process comprises sanding the entire surface of part 160 in a graduated manner, beginning with coarse sandpaper and ending with fine (600 grit) sandpaper. Part 160 may be then sprayed with low pressure cold water to remove dust. The side of part 160 which is to be the proximal side 116 of plate 12 is preferably given three coats of high quality polyurethane to effectively seal the wood and prevent any sweating from the wood and damage to the wearer's apparel. The side of part 160 which is to be the distal or exposed side 118 of plate 12 is preferably given five coats of high quality wax at predetermined intervals and buffed at the end of each interval. Approximate waxes and associated intervals are available and well known in the art.

After part 160 is finished to become plate 12, straps 120 and 121 are firmly affixed at slots 140 and 150, respectively, as explained above, to complete assembly of cummerbund 10.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A formal attire cummerbund assembly for placement at the waist of a user over other formal attire, said cummerbund assembly comprising:

a solid, rigid non-linear display for spanning across the abdominal region substantially between opposed hips of a user, the display comprising exposed wood at a front convex surface of the display and a rear concave surface which essentially contiguously conforms to the user's abdominal region, the display comprising two ends, one disposed during use near each hip of the user;

waistband means fastened to the respective ends of the display for holding the display securely across the user's abdominal region during use.

2. A formal attire cummerbund assembly for placement at the waist of a user over other formal attire, said cummerbund assembly comprising:

a solid, rigid non-linear thin one-piece wooden display for spanning across the abdominal region substantially between opposed hips of a user, the display comprising exposed wood at a front convex surface of the display and a rear concave surface of wood which essentially contiguously conforms to the user's abdominal region, the display comprising two ends, one disposed during use near each hip of the user;

waistband means fastened to the respective ends of the display and extending across the back of the user during use for holding the display between frontal hip regions securely across the user's abdominal region.

3. A formal attire cummerbund assembly for placement at the waist of a user over other formal attire, said cummerbund assembly comprising:

a wide substantially rigid cummerbund display, the display being curved between two ends thereof in general conformity of an abdominal region of a user between the hip regions of the user;

the cummerbund display comprising an exposed front convex surface of wood which curves as does said abdominal region and a rear concave surface which curves in substantial contiguity with formal wearing apparel at the abdominal region during use;

waistband means attached to the cummerbund display and located at the small of the user's back during use for holding the display in place across the abdominal region during use.

* * * * *